United States Patent [19]

Ohe et al.

[11] Patent Number: 4,473,341

[45] Date of Patent: Sep. 25, 1984

[54] BALANCED VANE OIL PUMPS

[75] Inventors: Takeshi Ohe; Hiroshi Ohsaki, both of Higashimatsuyama, Japan

[73] Assignee: Jidosha Kiki Co., Ltd., Tokyo, Japan

[21] Appl. No.: 418,565

[22] Filed: Sep. 15, 1982

[30] Foreign Application Priority Data

Oct. 8, 1981 [JP] Japan ..... 56-160682

[51] Int. Cl.[3] ..... F04B 49/02; F04B 49/08

[52] U.S. Cl. ..... 417/299; 417/304; 417/308; 417/310

[58] Field of Search ..... 417/299, 304, 308, 310

[56] References Cited

U.S. PATENT DOCUMENTS 4,400,139 8/1983 Masuda et al. ..... 417/308 X 4,408,964 10/1983 Mochizaki et al. ..... 417/310

4,421,462 12/1983 Ohe ..... 417/310

*Primary Examiner*—Richard E. Gluck

*Attorney, Agent, or Firm*—Charles E. Pfund

[57] ABSTRACT

In an oil pump having two pump cartridges each acting as independent pumps, a pair of suction passages and a pair of discharge passages opened in a pair of pump chambers in the pump cartridges are formed in one pump body secured to one side of the cartridges, a flow control valve is contained in an opening extending in an axial direction of the pump body, and a pressure sensitive flow passage change over valve is contained in another valve opening perpendicular to the valve opening. The two valve openings are communicated with the discharge and suction openings.

7 Claims, 9 Drawing Figures

BALANCED VANE OIL PUMPS

BACKGROUND OF THE INVENTION

This invention relates to a balanced vane type oil pump, and more particularly a small, light weight and inexpensive oil pump in which a pair of pump cartridges are used as two pumps and the supply of the pressurized oil outputted from each pump is selectively controlled to decrease power consumption.

In a power steering device mounted on a motor car, for example, for decreasing the handle steering power of the driver, a pump for producing pressurized oil for operating the power steering device is usually driven by the engine of the car so that the quantity of the oil discharged from the pump varies in proportion to the number of revolutions of the engine. Accordingly, such a pump is required to have a sufficient capacity to supply a quantity of the pressurized oil necessary to satisfactorily actuate a fluid device even when the engine speed is low, that is, when the discharge quantity of the pump is small.

However, when the pump capacity is increased to satisfy this requirement the discharge quantity of the pump becomes excessive in the high speed range of the engine, thus not only increasing the use of power of the engine for driving the pump but also the fuel consumption the engine.

Accordingly, it has been proposed to divide the pair of pump centridges into two pumps of small capacities and to provide a control member operating to selectively change over the flow passages which supply the pressurized oil from the oil pumps to fluid devices so as to save energy. With this arrangement when the output quantities of the pumps are small the two outputs are combined into a single flow and then supplied to the fluid devices, whereas when the discharge quantities of the pumps increase the output of only one pump is supplied to the fluid devices, while the other pump is connected to the suction side to circulate the oil so as to decrease the power necessary to drive the pumps.

However, the oil pumps just described are constructed to change over the flow passages by taking the number of revolutions of the engine as the reference, so that although it is possible to save the power in the high speed range of the engine, that is at the time when the motor car runs at high speeds, energy loss is inavoidable in the low speed range of the engine. Thus, there are many problems necessary to be solved.

More particulary in the power steering device of the type described above, the quantity of the pressurized oil supplied thereto is important when the power steering device is operating to produce a large power. In other cases, that is when the car is not running or runs without turning, even in the low speed range of the engine the quantity of the pressurized oil may be small. Especially, in a motor car, in many cases it runs according to 10 mode running patterns in a city area so that it is necessary to decrease the power consumption under such low speed running.

This problem can be solved by using a flow passage change over mechanism which operates in response to a load applied to the power steering device. When such change over mechanism is used, even when the engine operates at a high speed so that one pump can supply sufficient quantity of pressurized oil the changing over of the flow passages is performed, thus increasing the power consumption.

It has also been considered to electrically detect the running speed of the motor car to change over the flow passages in response to a detected signal, but since the car speed is not always proportional to the number of revolutions of the engine, that is the discharge quantity of the pump, it is not always possible to decrease the power consumption. Especially, in overloaded trucks or the like, even in a low speed running condition, in many cases, the engine reaches a high speed region thus inducing many problems. In addition, the use of electric detection means and an electromagnetic valve actuated thereby applies a limitation on the construction. The control member for controlling the quantity of the pressurized oil is required to have both performances of selectively changing over the flow passages from both pumps when necessary and of the flow quantity controlling the oil supplied to the fluid pressure devices below a predetermined quantity. Usually, these two performances have been provided by using a pair of spool valves controlling pressurized fluid passages associated therewith. In such a case the pair of spool valves and fluid passages that comprise the control member are incorporated into a pump body together with the pair of pump cartridges, whereby the construction and assembling of the oil pump become complicated.

When using a set of pump cartridges each comprising a rotor with vanes and a cam ring, etc., as two pumps, the following constructional problems arise.

More particularly, since a pair of pump cartridges are utilized as two oil pumps, according to a simplest design, a pair of independent pump chambers formed at symmetrical positions with respect to the rotor axis are communicated with separate discharge passages. One example of this construction is disclosed, for example, in Japanese Preliminary Patent Publication Nos. 49594 and 82868/1980. According to such construction, however, although the constructions of the pump passages and the control member can be simplified, where one pump chamber is connected to the tank side to unload the pump chamber, the other pump chamber performs the pumping action, so that unbalanced load would be applied upon the rotor and its shaft thus degrading the durability and reliability of the movable parts and increasing noise.

U.S. Pat. No. 2,887,060 discloses a balanced type pump free from the problems described above. According to this patent, two independent discharge passages are communicated with a pair of pump chambers symmetrically disposed about the rotor, and paired openings opened in respective pump chambers at symmetrical positions with respect to the rotor axis are combined so as to utilize the pump structure as two independent pumps. This construction, however, increases the number of oil passages so that the connections to respective parts and pipings to the spool valves acting as the control member become complicated.

Since in these pump cartridges, the control member and the oil passages are all contained in a single pump body, the problems described above have a large influence upon the construction, assemblying and the cost of the entire pump.

In the oil pump of the type described above it has been desired to provide a pump having a simple construction, easy to assembly and having small size and light weight. Such desire is especially important for such fluid device as a power steering device installed in a narrow space in an engine room of a motor car.

SUMMARY OF THE INVENTION

Accordingly, it is the principal object of this invention to provide a improved oil pump that can solve various problems described above.

Another object of this invention is to provide an improved oil pump consuming lesser power.

According to this invention, there is provided an oil pump of the type comprising a rotor, a cam ring surrounding the rotor for defining a pair of pump chambers symmetrical with respect to the axis of the rotor, a pair of pump bodies secured to both sides of the cam ring, characterized in that one of said bodies is provided with suction passages, first and second discharge passages which open into respective pump chambers at a predetermined spacing in a direction of rotation of the rotor, a flow control valve contained in a valve opening and including a spool responsive to a pressure differential at a metering orifice in the first discharge passages, the spool interconnecting the first discharge passages to the suction passages when the quantity of oil flowing through the first discharged passages exceeds a predetermined value, and a pressure responsive flow passage change over valve including a spool and a check valve, the last mentioned spool normally connecting the second discharge passages to the suction passages, whereas when pressure of the oil in the first discharge passages exceeds a predetermined value, connecting the second discharge passages to the first discharge passages through the check valve.

DESCRIPTION OF THE PREFERRED EMBODIMENT

The embodiment of this invention illustrated in the accompanying drawings is used for a power steering device of a motor car.

Figure 2:
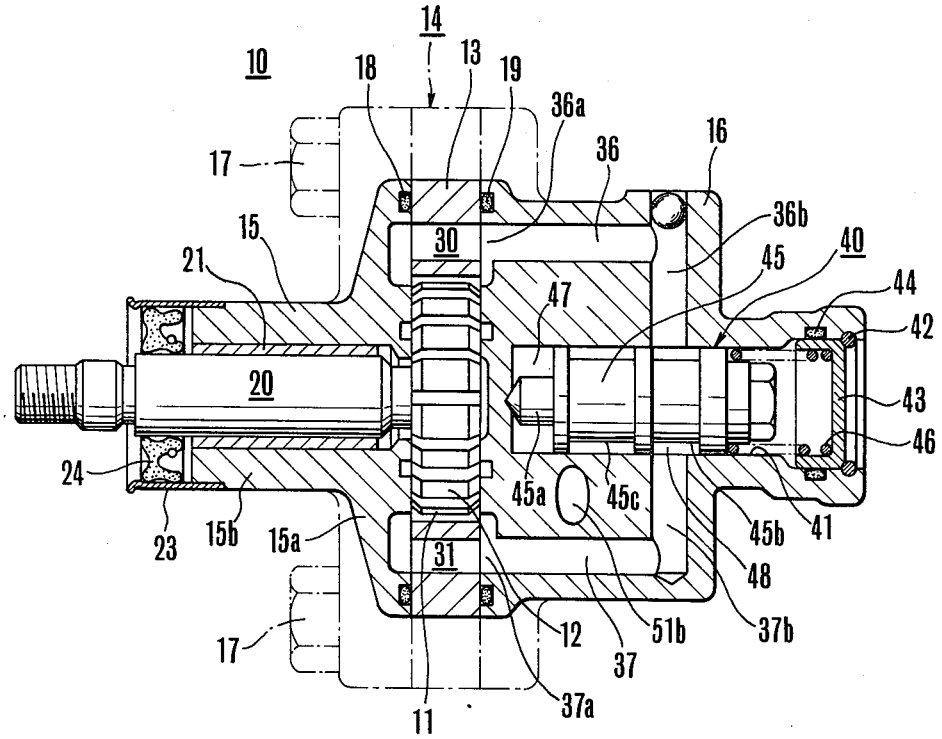

In these drawings, an oil pump generally designated by a reference numeral 10 comprises a cylindrical rotor 12 having a plurality of radially slidable vanes 11, and a cam ring 13 surrounding the rotor 12 and formed with a substantially elliptical cam surface 13*a*, the rotor and the cam ring constituting a set of pump cartridges 14. A front body 15 and a rear body 16 respectively forming pump bodies are secured to the opposite sides of the pump cartridges. As shown in FIG. 2, the front and rear bodies 15 and 16 are secured by four bolts 17 at the peripheral portion to clamp the cam ring 13. Thus, according to this invention, side plates and pressure plates which were indispensable for the prior art pressure loading type oil pump are not used thus decreasing the number of component parts so as to simplify the assembling and to make small and size of the pump. Since in a small oil pump of this type, the discharge pressure is low so that even when the cartridges are clamped directly between the front and rear bodies the operation of the pump does not deteriorate. O-rings 18 and 19 are provided between the cam ring 12 and the front and rear bodies 15 and 16 respectively.

Figure 1:
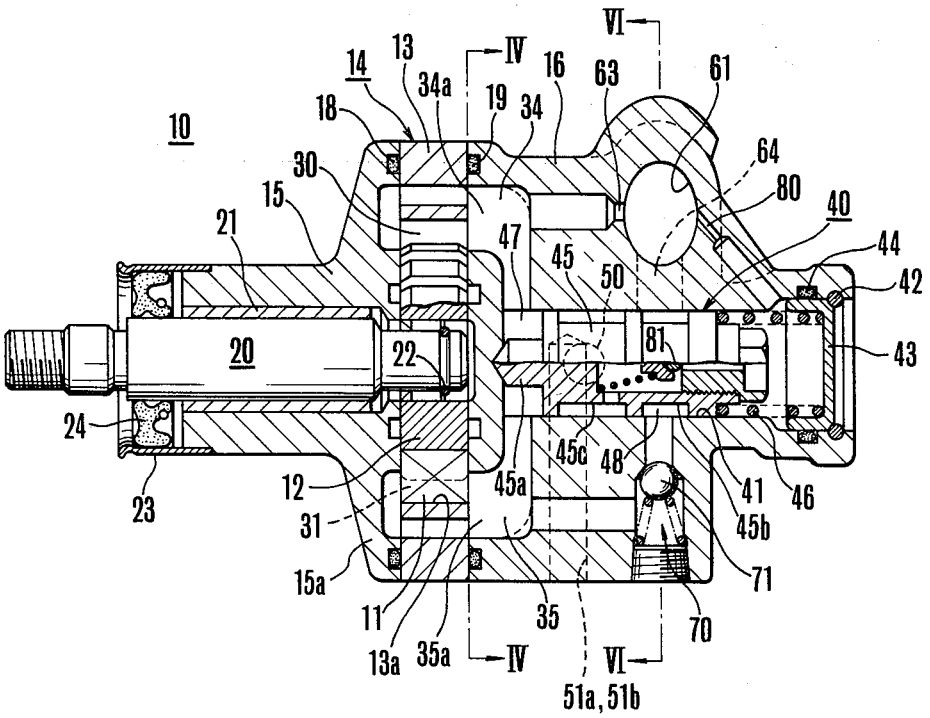
FIGS. 1, 2 and 3 are longitudinal sectional views taken along different sections for better understanding of the overall construction of one embodiment of the oil pump according to this invention.
Figure 3:
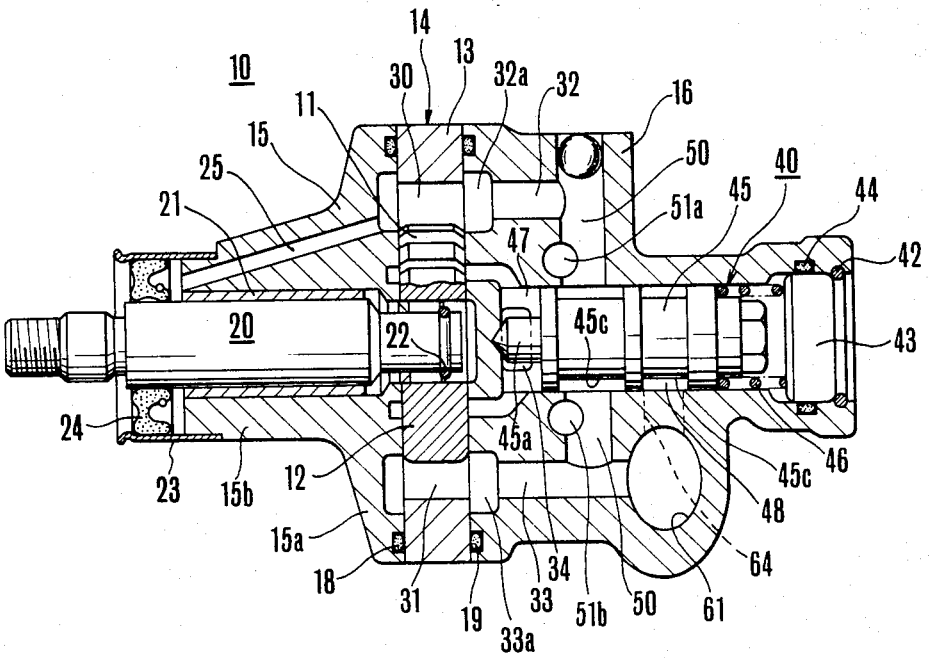

As shown in FIGS. 1 to 3, the front body 15 comprises a circular disc shaped portion 15*a* adapted to be urged against one side of the pump cartridges 14 and a cylindrical portion 15*b* projecting in the axial direction from the central portion of the disc shaped portion 15*a*. A rotary shaft 20 of the rotor 12 driven by a motor car engine extends through a central opening of the front body 15 and is journalled by a plain bearing 21. The inner end of the rotary shaft 20 is coupled with the rotor 12 with splines and held by a snap spring 22 (FIG. 2) against withdrawal. A collar 23 is secured to the outer end of the cylindrical portion 15*b* and an oil seal 24 is interposed between the collar 23 and the rotary shaft 20. As shown in FIG. 3, an oil returning passage 25 is formed through the cylindrical portion 15*b* for returning the oil leaking along the rotary shaft 20 to the suction side of the pump. In this embodiment, the cylindrical portion 15*b* is tapered towards its front (left) end and when the oil seal 24 is secured by the collar 23, it becomes easy to divide the front body 15 in the longitudinal direction so as to improve the moldability and the assemblying of the parts. This construction also decreases the weight of the pump.

Figure 4:
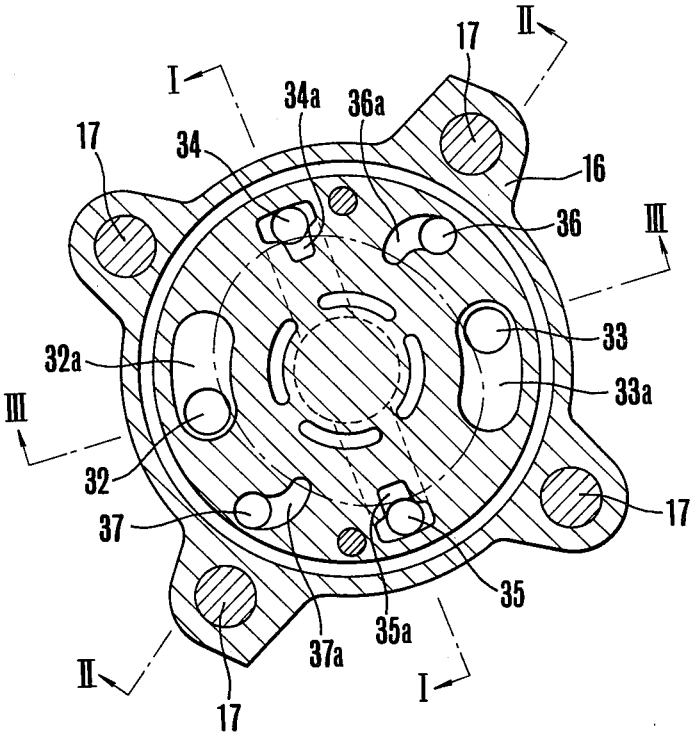
FIG. 4 is a cross-sectional view taken along a line IV—IV in FIG. 1 and indicating the sections view in FIGS. 1, 2 and 3.
Figure 5:
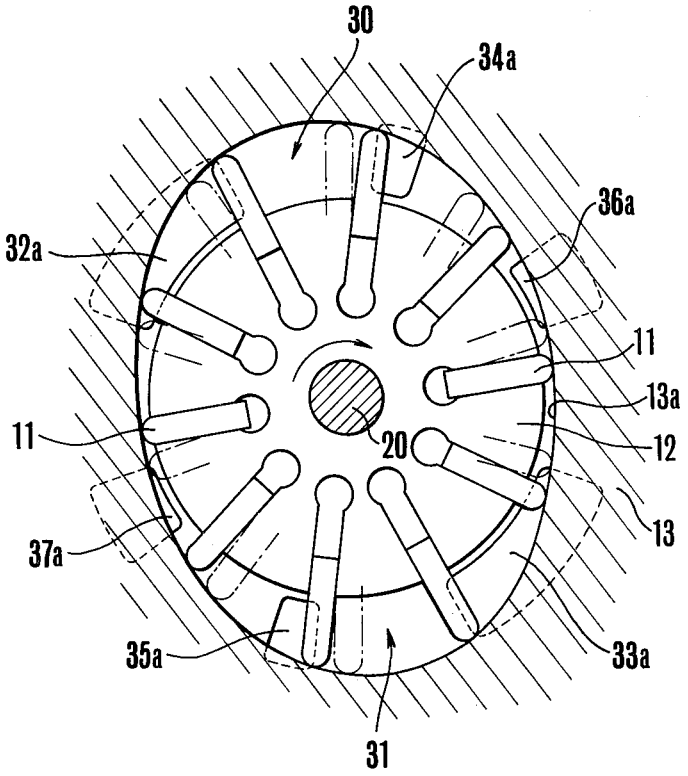
FIG. 5 is a cross-sectional views for explaining the relationship between respective oil passages and the pump chambers for utilizing a set of pump cartridges as two pumps.

As shown in FIGS. 4 and 5, suction ports 32*a* and 32*b* communicated with paired pump suction passages 32 and 33 respectively open in a pump chambers 30 and 31 formed in the pump cartridges 14 at positions symmetrical with respect to the axis of the rotor 12, and a pair of discharge ports 34*a*, 35*a*; 36*a* 37*a* respectively communicating with first and second discharge passages 34, 35; 36 37 which are spaced a predetermined spacing in the direction of rotation of the rotor 12. Paired suction ports, the first discharge ports 34*a*, 35*a*, and the second discharge ports 36*a*, 37*a* respectively open in the pump chambers 30 and 31 are provided at points symmetrical with respect to the axis of the rotor 12. Pressurized oils discharged from paired first and second discharge ports 34*a*, 35*a*; 36*a*, 37*a* are supplied to independent passages to utilize the pump structure as two independent pumps.

More particularly, for the purpose of utilizing a set of pump cartridges as two oil pumps, the discharge regions of the pump chambers 30 and 31 formed at positions symmetrical with respect to the axis of the rotor 12 are divided into two and by combining paired portions it is possible to provide well balanced pumping action. According to such balanced two stage type oil pump, even when the pump is unloaded by communicating one discharge port with an oil tank, a balanced load would be applied upon the rotor, thus preventing unbalanced wear of the movable parts of the pump, thus not only increasing the durability and reliablity but also preventing generation of noise.

According to this invention, the suction passages 32 and 33 supplying pressurized oil from the tank to respective pump chambers 30 and 31 in the pump cartridges, the first and second discharge passages 34, 35; 36, 37 supplying in two directions the pressurized oil discharged from the pumping action are disposed in the rear body 16 together with a flow control valve 40 that controls the flow of the pressurized oil and a pressure sensitive type flow passage change over valve 60 by considering their relative positions so that it is possible to provide a compact, small size and light weight pump that can be machined readily.

More particularly, a valve opening 41 opening at the center of the rear end of the rear body 16 urged against the rear sides of the pump cartridges is provided at a position coaxial with the rotary shaft 20 of the rotor 12 and the opening 41 is closed by a closure plug 43 secured to the end of the opening by a snap ring 42. An O-ring 44 is provided to seal the plug 43. In the opening 41 is contained a spool 45 of the flow control valve 40 to be slidable in the longitudinal direction and the spool 45 is biased by a spring 46 toward the rotor 12. A rod **45*a* is provided for the inner end of the spool 15 and a high pressure chamber 47 is firmed about the rod 45*a*. As shown in FIG. 1, first pump discharge passages 34 and 35 perpendicular to the opening 41 are provided to oppose each other, portions of the first pump discharge passages extending in the axial direction of the rear body 16 from the first discharge ports 34*a* and 35*a***.

As shown in FIG. 2, the second discharge passages 36 and 37 respectively communicated with the second discharge ports **36*a* and 37*a* extend in the axial direction toward the rear or outer end of the rear body 16 beyond the first discharge passages 34 and 35 and are communicated with the valve opening 41 through diametrical passages 36*a* and 37*b* drilled from the periphery of the rear body 16. The pressurized oil in the second discharge passages 36 and 37 normally flows into the valve chamber 48 defined by an annular groove 45*b* between the rear side lands of the spool 45**.

As shown in FIG. 3 the suction passages 32 and 33 conveying the oil from the tank, not shown to the pump chambers 30 and 31 via suction ports **32*a* and 33*a* extend rearwardly along the axis of the rear body 16 and are interconnected by a passage 50 drilled from the periphery of the rear body to cross the valve opening 41, and the passage 50 is communicated with a pair of passages 51*a* and 51*b* drilled through a cylindrical portion 16*a* on the bottom of the rear body 16. A suction side connector 52 connected to the oil tank is secured to the lower end of the cylindrical portion 16*a* for supplying the oil to the pair of passages 51*a* and 51*b***.

It is to be particularly noted that the passage 50 that interconnects the suction passages 32 and 33 is positioned in the valve opening 41 such that the passage 50 is located between the pairs the first and second discharge passages 34, 35 and 36, 37. Adjacent the opening of the passage 50 is formed an annular groove **45*c* at the axial center of the spool 45. In an non-operating state, the annular groove 45*c* interconnects the paired suction passages 32 and 33, while the first and second discharge passages 34, 35; 36, 37 are interrupted from each other by the lands of the spool 45**.

As the spool 45 is operated due to an increase in the flow quantity passing through a metering orifice to be described later, the high pressure chamber 47 into which the first pair of the pump discharge passages 34 and 35 open will be connected to the suction passages 32 and 33 through the passage 50, while the second pair of discharge passages 36 and 37 will be connected to the suction passages 32 and 33 via the passage 50.

Figure 6:
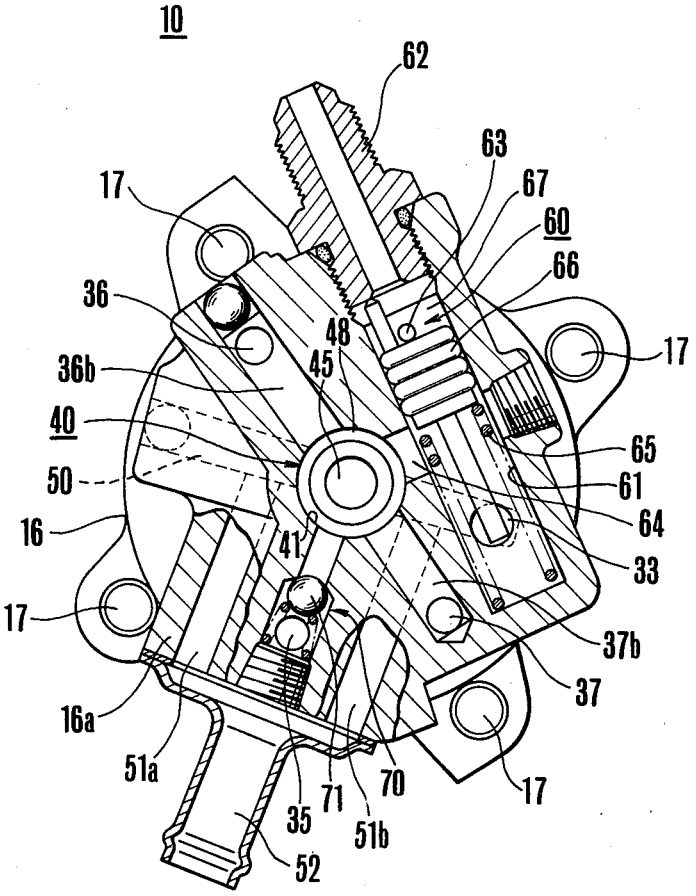
FIG. 6 is a cross-sectional view taken along a line V1—V1 in FIG. 1.
Figure 7:
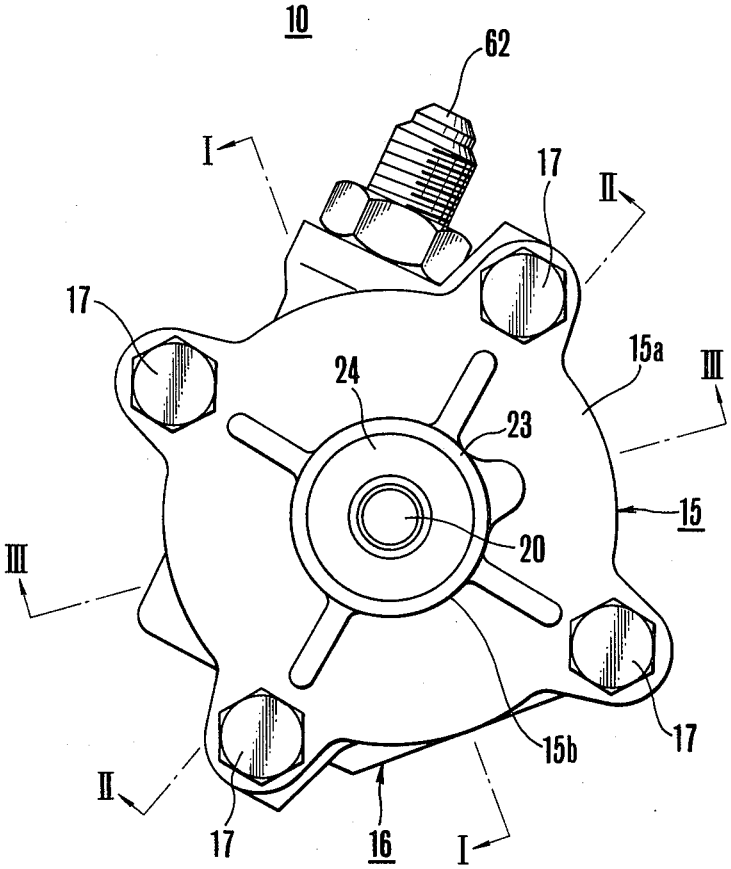
FIG. 7 is a front view of the pump.
Figure 8:
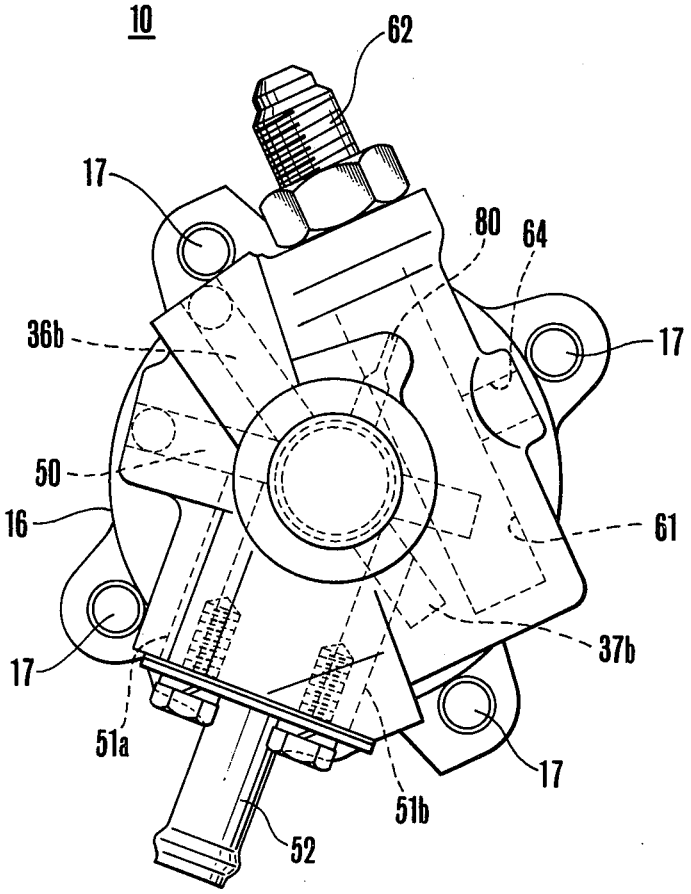
FIG. 8 is a rear view thereof.
Figure 9:
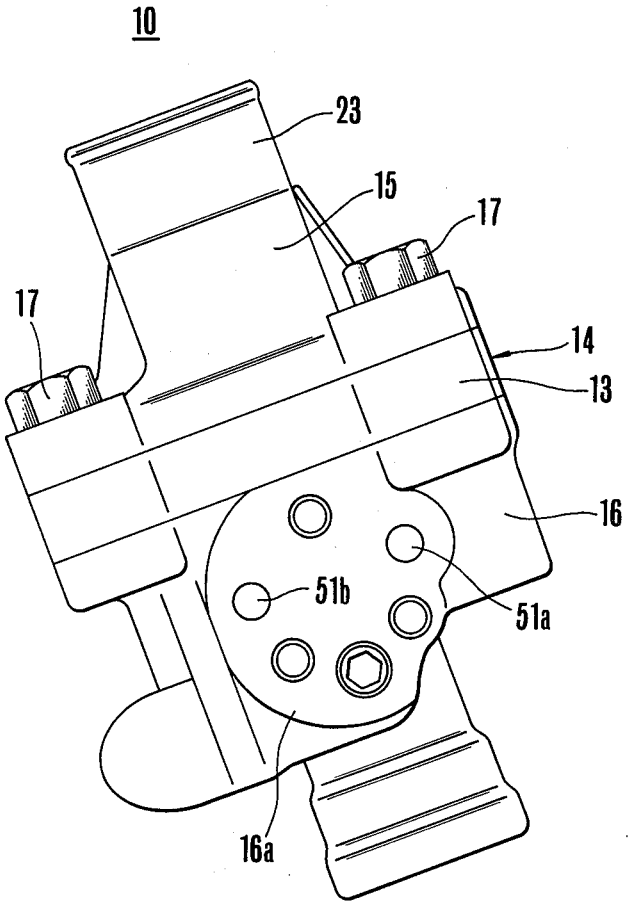
FIG. 9 is a bottom view of the pump.

As shown in FIGS. 1 and 6, a pressure sensitive type fluid passage change over valve 60 that interconnects or interrupts the first and second discharge passages 34, 35; 36, 37 by detecting an increase in the load of the fluid machine is disposed in a valve opening 61 formed at the central portion of the rear body 16 and in a direction perpendicular to the valve opening 41 of the flow control valve 40. A discharge connector 62 is connected to the exit end of the valve opening 61 for sending the pressurized oil discharge from the pump to the fluid machine, and the inside of the connector 62 is connected to the first discharge passage 34 via a metering orifice 63. The other end of the valve opening 61 is connected to the suction passage 33. The central portion of the valve opening 61 is connected to the valve chamber 48 into which the second discharge passages 36 and 37 open, through a passage 64 leading to the valve opening 41 containing the flow control valve 40, the passage 64 being drilled from one side of the rear body 16.

A spool 66 normally urged against the discharge connector 62 by a spring 65 is slidably received in the valve opening 61. Normally, the spool 66 is positioned between the metering orifice 63 and the opening of the passage 64 so as to connect the valve chamber 48 with the suction passage 33. When the fluid machine is operated so that the pressure in the high pressure chamber 67 rises into which the metering orifice 63 opens the spool 66 is moved in a direction opposite to the connector 62 to close the opening of the passage 64, thereby disconnecting the second discharge passages 36 and 37 from the suction passages 33.

It should be particularly noted that the valve opening 61 of the flow passage change over valve 60 is positioned in such a position that its both ends can be communicated with one of the suction passages 32 and 33 axially extending through the rear body 16, and one of the first discharge passages 34 and 35 through straight passages. This construction, simplifies the construction of the passages associated with the valve openings and facilitates the machining of these passages.

As shown in FIGS. 1 and 6, a radial passage 70 is formed at the axial center of the valve opening corresponding to the valve chamber 48 in the flow control valve 40 connected to the second discharge passages 36 and 37 and the passage 70 is connected to an extension of the other 35 of the first pump discharge passages extending in the axial direction of the rear body. A check valve 71 is disposed at an intermediate point of the passage 70 for combining the pressurized oil in the second discharge passages 36 and 37 with that in the first discharge passages 34 and 35.

Accordingly, when the flow passage change over valve 60 operates to close the opening of the passage 64 by the spool 66 and when the spool 45 of the flow control valve 40 is in an inoperative state, the pressurized oil in the second discharge passages 36 and 37 would be combined with that of the first discharge passaages 34 and 35 by the operation of the check valve 71.

There are also provided a damper orifice 80 for conveying the pressurized oil on the downstream side of the metering orifice 63, that is in the high pressure chamber 67 of the change over valve 60 to the low pressure chamber of the flow control valve 40, and a relief valve 81 contained in the spool 45 of the flow control valve 40. The outer ends of the passages **36*b*, 37*b*, 50, 64 and 70 drilled from the periphery of the rear body 16** are closed by plugs.

The oil pump 10 supplies pressurized oil to the power steering device in the following manner.

When the engine speed is low and the power steering device is in the non-operating state, that is under no load state, and when the pressure of the oil supplied to the connector 62 from the first discharge passages 34 and 35 is low, both the flow control valve 40 and the change over valve 60 are maintained in their non-operating states so that only the pressurized oils in the first discharge passages 34 and 35 are combined in the high pressure chamber 47 and then discharged to the discharge connector 62 through the metering orifice 63, and the high pressure chamber 67 of the flow passage change over valve 60. At this time, the pressurized oils in the second discharge passages 36 and 37 flow into the low pressure side of the flow passage change over valve 60 via the valve chamber 41 of the flow control valve 40 and then led to the suction passage 33. Consequently, the oil is circulated through the pump and the tank, thus unloading the pump, so that the power for driving the pump is reduced to one half, thus saving energy. Since the power steering device is non-operating at this time, even when a small quantity of the oil is supplied, there is no trouble.

When the speed of the pump is low, as the pressure in the high pressure chamber 67 in the flow passage change over valve 60 rises, the spool 66 moves toward the low pressure chamber to close the passage 64 so as to interrupt the second discharge passages 36 and 37 from the suction passage 33. At this time, since the flow control valve 40 is non-operating, by the operation of the check valve 71, the pressurized oils in the second discharge passages 36 and 37 are combined in the valve chamber 48 and then sent to the first discharge passages 34 and 35 to be combined with the oils therein, whereby the resultant pressurized oil is discharged through the discharge connector 62. Thus, the supply of the pressurized oil necessary to operate the power steering device can be assured. Of course, at this time, the power for driving the pump is not decreased.

When the discharge quantity of the pump increases beyond a predetermined quantity with the increase in the number of revolutions, and when the power steering device is non-operating, that is under a high speed low pressure state, the flow control valve 40 is operated by the pressure differential at the metering orifice 63 to bypass a portion of the pressurized oils in the first discharge passages 34 and 35 to the pump suction side to control the quantity of the oil supplied to the power steering device to a constant value. At this time, the flow passage change over valve 60 is inoperative and the pressurized oils in the second discharge passages 36 and 37 is sent to the suction passage 33 via the valve chamber 48 and the passage 64, and a portion of the oils is returned to the suction passages 32 and 33 via the annular groove **45*c* of the spool 45**, thus unloading the pump to decrease its power consumption.

Further, under a high speed condition when the power steering device operates to increase the oil pressure, the flow passage change over valve 60 also operates to disconnect the passage 64 from the suction side. At this time, since the flow control valve 40 is operating the second discharge passages 36 and 37 are communicated with the suction passages via the annular groove **45*c* of the spool 45, the pressurized oil would be returned to the tank thereby maintaining no load condition. Of course, a portion of the pressurized oils in the first discharge passages 34 and 35 are returned to the tank by the operation of the flow control valve 46**, whereby a definite quantity of the pressurized oil is supplied to the power steering device.

In this manner, the pressurized oils supplied from the first and second discharge passages 34, 35; 36, 37 can be efficiently controlled in accordance with a unique combination of the number of revolutions of the pump and the operative and non-operating conditions of the power steering device, thus decreasing the power consumption of the pump.

As above described, according to this invention, in a pump comprising a pair of cartridges which are controlled in a manner described above, since the first and second discharge passages 34, 35; 36, 37 opened in the pair of pump chambers 30 and 31 formed on the periphery of the rotor are provided, there is no fear of applying unbalanced load to the rotor 12, and the durability and the reliability of the movable portions of the pump can be improved.

Although in the foregoing embodiment the valve opening 41 of the flow control valve 40 is formed at the center of the rear body 16 in coaxial with the rotor shaft 20, and the valve opening 61 of the flow passage change over valve 60 is formed at right angles with respect to the valve opening 41, it should be understood that the invention is not limited to such specific construction, that both valves may be arranged in a similar positional relation and that various passages may be changed suitably.

Furthermore, instead of coupling together the cam ring 13 constituting the pump cartridge 14, and the front and rear bodies 15 and 16 by bolts 17 passing through ears (see FIG. 4) the front and rear bodies 15 and 16 may be secured to the cam ring with positioning pins or the like without using the ears.

It should also be understood that the oil pump 10 of this invention can also be applied to other pressurized oil machines and devices than a power steering device which are required to have small size and light weight.

As above described, according to the oil pump embodying the invention, a flow control valve is disposed in the axial direction of a pump body attached to one side of a pump cartridge, paired suction passages, and paired first and second discharges passages opened in a pair of pump chambers in a pump cartridge, are opened in a valve opening in the pump body, respectively in opposed relations, and a flow passage change over valve of the pressure sensitive type is provided at right angles with respect to the valve opening so that it is possible to simplify the construction, manufacturing, and assembling of various component elements, thus providing small, compact and inexpensive oil pump of low power consumption.

Furthermore, according to this invention, it is not only possible to improve the durability and reliability of the movable portions of the pump but also possible to decrease as far as possible the pressure loss in the passages because they are arranged efficiently, thereby decreasing power loss. Moreover as the passages from the suction and discharge ports are opened in opposed relations in the valve opening, the spool can move smoothly to make sure its control function.

What is claimed is:

1. An oil pump of the type comprising:

a rotor (12);

a cam ring (13) surrounding said rotor for defining a pair of pump chambers (30, 31) symmetrical with respect to an axis of said rotor;

a pump body assembly including said cam ring and said rotor, characterized in that said pump assembly is provided with suction passages (32, 33), and first and second discharge passages (34, 35: 36, 37) which open into respective pump chambers at a predetermined spacing in a direction of rotation of said rotor (12), a flow control valve (40) provided with a spool (45) responsive to a pressure differential at a metering orifice (63) in said first discharge passages (34, 35), to said suction passages (32, 33) when quantity of oil flowing through said first discharge passages (34, 35) exceeds a predetermined value, and a pressure sensitive flow passage change over valve (60) including a spool (66), said last mentioned spool (66) normally connecting said second discharge passages (36, 37) to said suction passages (32,33), whereas, when pressure of the oil in said first discharge passages (34, 35) exceeds a predetermined value, connecting said second discharge passages (36, 37) to said first discharge passages (34, 35) through a check valve (71).

2. The oil pump according to claim 1 wherein said pump body assembly comprises a pair of pump bodies directly secured to both sides of said cam ring.

3. The oil pump according to claim 1 wherein said spool of said flow control valve and said spool of said flow passage change over valve are respectively contained in valve openings which are arranged perpendicular to each other.

4. The oil pump according to claim 1 wherein said suction passages and said first and second discharge passages substantially extend in parallel with a valve opening of said flow control valve extending in an axial direction of said one pump body assembly, said first discharge passages open in a front portion of said valve opening, said second discharge passages open at an axial center of said valve opening, and said suction passages open in said valve opening between said discharge passages.

5. The oil pump according to claim 1 wherein one end of the valve opening constituting said pressure sensitive type flow passage change over valve is connected to said suction passages, whereas the other end is communicated with said first discharge passages through said metering orifice.

6. The oil pump according to claim 1 wherein said second discharge passages opening, in opposed relation, in the axial center of the valve opening constituting said flow control valve are communicated with said valve opening constituting said flow passage change over valve via a space defined by lands of said flow control valve spool so that said second discharge passages are normally connected with said suction passages by said flow control valve spool.

7. The oil pump according to claim 1 wherein opposite ends of said valve opening constituting said flow passage change over valve are located at positions connectable with one of the axially extending suction passages and with one of said discharge passages.

* * * * *